US007473871B2

(12) United States Patent
Tajima et al.

(10) Patent No.: US 7,473,871 B2
(45) Date of Patent: Jan. 6, 2009

(54) HEATING APPARATUS, FIXING APPARATUS AND IMAGE FORMING APPARATUS

(75) Inventors: Noriyuki Tajima, Fukuoka (JP); Koichi Baba, Fukuoka (JP); Akihiro Yasuda, Fukuoka (JP); Keisuke Fujimoto, Fukuoka (JP); Shigemitsu Tani, Fukuoka (JP); Masayuki Isayama, Fukuoka (JP)

(73) Assignee: Panasonic Corporation, Osaka (JP)

( * ) Notice: Subject to any disclaimer, the term of this patent is extended or adjusted under 35 U.S.C. 154(b) by 13 days.

(21) Appl. No.: 10/596,193

(22) PCT Filed: Nov. 24, 2004

(86) PCT No.: PCT/JP2004/017408

§ 371 (c)(1),
(2), (4) Date: Jun. 2, 2006

(87) PCT Pub. No.: WO2005/055669

PCT Pub. Date: Jun. 16, 2005

(65) Prior Publication Data

US 2007/0041757 A1 Feb. 22, 2007

(30) Foreign Application Priority Data

Dec. 3, 2003 (JP) ..... 2003-404944

(51) Int. Cl.
*H05B 6/14* (2006.01)
*G03G 15/20* (2006.01)

(52) U.S. Cl. ..... 219/619; 219/667; 219/670; 219/676; 399/328; 399/330

(58) Field of Classification Search ..... 219/619, 219/652, 667, 670, 673–677; 399/328–335
See application file for complete search history.

(56) References Cited

U.S. PATENT DOCUMENTS 6,495,811 B2 * 12/2002 Nitsche et al. ..... 219/619

(Continued)

FOREIGN PATENT DOCUMENTS

JP 57-133468 * 8/1982 ..... 399/331

(Continued)

OTHER PUBLICATIONS

English Language Abstract of JP 2003-017221.

(Continued)

*Primary Examiner*—Philip H Leung
(74) *Attorney, Agent, or Firm*—Greenblum & Bernstein, P.L.C.

(57) ABSTRACT

A heating apparatus that enables an abnormally high temperature detection section that detects, when a heating element heated by means of electromagnetic induction reaches an abnormally high temperature, this abnormally high temperature, to operate speedily and reliably irrespective of the material and temperature characteristic of the heating element in a low-cost and compact configuration. In this apparatus, thermostat 301 is disposed on the same side as exciting coil 231 with respect to heat generating belt 210 and between winding bundles of a conductor wire of exciting coil 231. This allows coil guide 234 to hold both thermostat 301 and exciting coil 231 and allows these wires and terminals to be concentrated on one location, thus making it possible to reduce the number of parts and assembling man-hours and configure the body of the apparatus in a low-cost and compact configuration. Furthermore, thermostat 301 operates reliably when heat generating belt 210 reaches an abnormally high temperature irrespective of whether the material of heat generating belt 210 is a magnetic member or not and whether the temperature of heat generating belt 210 has exceeded a Curie temperature or not.

10 Claims, 8 Drawing Sheets

U.S. PATENT DOCUMENTS

| | | | |
|---|---|---|---|
| 6,625,417 | B1 | 9/2003 | Terada et al. |
| 2006/0072931 | A1 | 4/2006 | Asakura et al. |
| 2006/0099001 | A1 | 5/2006 | Asakura et al. |

FOREIGN PATENT DOCUMENTS

| | | | |
|---|---|---|---|
| JP | 2-120797 | | 9/1990 |
| JP | 7-319312 | | 12/1995 |
| JP | 8-016006 | | 1/1996 |
| JP | 2001-188430 | | 7/2001 |
| JP | 2001-267050 | | 9/2001 |
| JP | 2003-017221 | | 1/2003 |
| JP | 2003-091186 | | 3/2003 |
| RU | 2055913 | * | 3/1996 |

OTHER PUBLICATIONS

English Language Abstract of JP 2001-188430.
English Language Abstract of JP 8-016006.
English Language Abstract of JP 2003-091186.
English Language Abstract of JP 7-319312.
English Language Abstract of JP 2001-267050.

* cited by examiner

HEATING APPARATUS, FIXING APPARATUS AND IMAGE FORMING APPARATUS

TECHNICAL FIELD

The present invention relates to a heating apparatus according to an electromagnetic induction heating scheme, and more particularly, to a heating apparatus suitable for use in a fixing apparatus of an image forming apparatus such as a copier, facsimile or printer based on an electrophotographic scheme or electrostatic recording scheme.

BACKGROUND ART

A heating apparatus based on an electromagnetic induction heating (IH: Induction Heating) scheme is designed to cause a magnetic field generated by a magnetic field generation section to act on a heating element, generate an eddy current and cause the heating element to generate Joule heat by this eddy current. This heating apparatus can be used, for example, as a fixing apparatus of an image forming apparatus that causes an unfixed image formed on a recording medium such as transfer paper and an OHP (OverHead Projector) sheet by the image forming section to be heat-fixed.

This fixing apparatus using a heating apparatus based on an electromagnetic induction heating scheme has an advantage of higher heat generation efficiency than a thermal roller type apparatus using a halogen lamp as a heat source and being able to enhance the heat rising speed of a heating element.

Furthermore, a fixing apparatus using a thin-walled heating element made up of thin-walled sleeve or endless belt as the heating element has the heating element of a small thermal capacity, can cause this heating element to be heated in a short time, and can thereby significantly improve rising response before the heating element is heated up to a predetermined temperature.

On the other hand, the fixing apparatus using this type of a heating apparatus takes some safety measures to prevent the heating element from exhibiting runaway effect due to failure of a temperature control system or the like causing fire or producing smoke in a flammable section.

As one such conventional fixing apparatus, a fixing apparatus which disposes a thermostat as an abnormally high temperature detection section which operates upon receiving operating energy through thermal conduction so as to contact a local heat generating part of a heating roller as the heating element and shuts off a current supplied to a circuit that controls the temperature of this heating roller when the surface temperature of the heating roller reaches a predetermined abnormally high temperature using the thermostat is known (for example, see Patent Document 1).

However, in the fixing apparatus disclosed in Patent Document 1, an exciting coil which is the magnetic field generation section and the thermostat are disposed on opposite sides across the heating roller as the heating element, and therefore members for holding the thermostat and exciting coil, wires and terminals are necessary, which causes a problem of increasing the number of parts and assembling man-hours and also the area occupied by the apparatus.

Furthermore, in the case of the fixing apparatus disclosed in Patent Document 1, if its heating roller is made of a magnetic member, when the temperature of the heating roller exceeds its Curie temperature, magnetic permeability of the magnetic member of the heating roller decreases drastically and magnetic flux leaks from the heating roller. This leakage flux is induced to the magnetic member around the heating roller and causes the part of the heating roller facing this magnetic member to locally generate high heat. For this reason, in this fixing apparatus, when high heat is locally generated in any parts other than the location of the thermostat as described above, the fixing apparatus itself may be damaged or catch fire before the thermostat operates. Especially, when the rotation of the heating roller is stopped, there is a problem that even if high heat is generated locally in any part other than the location of the thermostat, the thermostat does not operate.

As a heating apparatus to solve the above described problem caused by the temperature of the heating roller exceeding its Curie temperature, a heating apparatus comprising a thermo switch as an abnormally high temperature detection section disposed at a position facing an exciting coil as the magnetic field generation section with a heating member as the heating element interposed in between, and further a leakage flux induction member disposed at or near the position of the thermo switch and made up of a magnetic member that induces leakage flux from the heat generating layer generated when the temperature of the heat generating layer of the heating member exceeds the Curie temperature of the magnetic member of the heat generating layer is known (for example, see Patent Document 2).

In the case of the heating apparatus according to this Patent Document 2, when its temperature adjustment/control system does not operate normally due to a failure of the apparatus or the like and its excessive power supply to the exciting coil continues, the temperature due to heat generation of the heating member increases. At this time, when the temperature of the heat generating layer of the heating member exceeds the Curie temperature of the magnetic member used for the heat generating layer, the magnetic permeability of the heat generating layer decreases drastically and magnetic flux which has formed a magnetic path in the heat generating layer leaks. Most of this leakage flux is induced to the leakage flux induction member. This causes the magnetic flux in the heat generating layer of the heating member at a position facing the leakage flux induction member to increase relatively compared to other parts and causes the temperature of the heating member to increase locally in this part, causing the thermo switch to operate earlier.

For this reason, in the heating apparatus disclosed in Patent Document 2, when runaway effect is produced due to a failure in its temperature control system and the temperature of the heat generating layer of the heating member reaches an abnormally high temperature which exceeds the Curie temperature of the electrically conductive magnetic member making up the heat generating layer, this allows the thermo switch which is a thermosensitive safety apparatus to operate earlier in order to shut off a power supply to the heating apparatus.

Patent Document 1: Japanese Patent Application Laid-Open No. HEI7-319312

Patent Document 2: Japanese Patent Application Laid-Open No. 2001-267050

DISCLOSURE OF INVENTION

Problems to be Solved by the Invention

However, in the heating apparatus disclosed in Patent Document 2, since the exciting coil and thermo switch are disposed on the opposite sides across the fixing film which is the heating member, members for holding the thermostat and exciting coil, wires and terminals are necessary separately, which causes the same problem as in Patent Document 1 of increasing the number of parts and assembling man-hours, and also the area occupied by the apparatus.

Furthermore, in the heating apparatus disclosed in Patent Document 2, when the temperature of the magnetic member used for the heat generating layer of the heating member does not exceed its Curie temperature, the leakage flux is not induced to the leakage flux induction member, and therefore the thermo switch may not operate even if the heating member reaches the abnormally high temperature.

Furthermore, in the heating apparatus disclosed in Patent Document 2, when the heating member is made of a non-magnetic member which allows magnetic flux to pass, the magnetic flux from its exciting coil passes through the heating member, and therefore the magnetic flux which has passed through this heating member is directly induced to the leakage flux induction member and the leakage flux induction member is heated. For this reason, in this heating apparatus, the heating member is locally heated due to thermal conduction from the leakage flux induction member, which may cause a temperature distribution of the heating member due to heat generation to become uneven. Furthermore, in this heating apparatus, the leakage flux induction member is directly heated by magnetic flux which has passed through the heating member, and therefore the thermo switch may operate even if the heating member does not reach an abnormally high temperature.

It is therefore an object of the present invention to provide a heating apparatus of a low-cost, compact configuration capable, when a heating element reaches an abnormally high temperature, of speedily and reliably operating an abnormally high temperature detection section that detects this abnormally high temperature irrespective of the material and temperature characteristic or the like of the heating element heated by means of electromagnetic induction.

Means for Solving the Problem

The heating apparatus of the present invention comprises an exciting coil made up of a plurality of windings of a conductor wire for generating a magnetic field, a heating element heated by means of electromagnetic induction through an action of the magnetic field and an abnormally high temperature detection section that detects that the heating element reaches an abnormally high temperature, wherein the abnormally high temperature detection section is disposed on the same side as the exciting coil with respect to the heating element and between winding bundles of the conductor wire of the exciting coil.

Advantageous Effect of the Invention

According to the present invention, when the heating element reaches an abnormally high temperature, it is possible to speedily and reliably operate the abnormally high temperature detection section irrespective of the material and temperature characteristic of the heating element heated by means of electromagnetic induction and thereby secure safety even when the heating element reaches an abnormally high temperature. Furthermore, according to the present invention, the abnormally high temperature detection section is disposed on the same side as that on which the exciting coil is disposed, and it is possible to thereby achieve commonality of a holding member for the abnormally high temperature detection section and the exciting coil and dispose wires and terminals thereof concentrated on one location and thereby provide a low-cost, compact heating apparatus capable of reducing the number of parts and assembling man-hours.

BEST MODE FOR CARRYING OUT THE INVENTION

Figure 1:
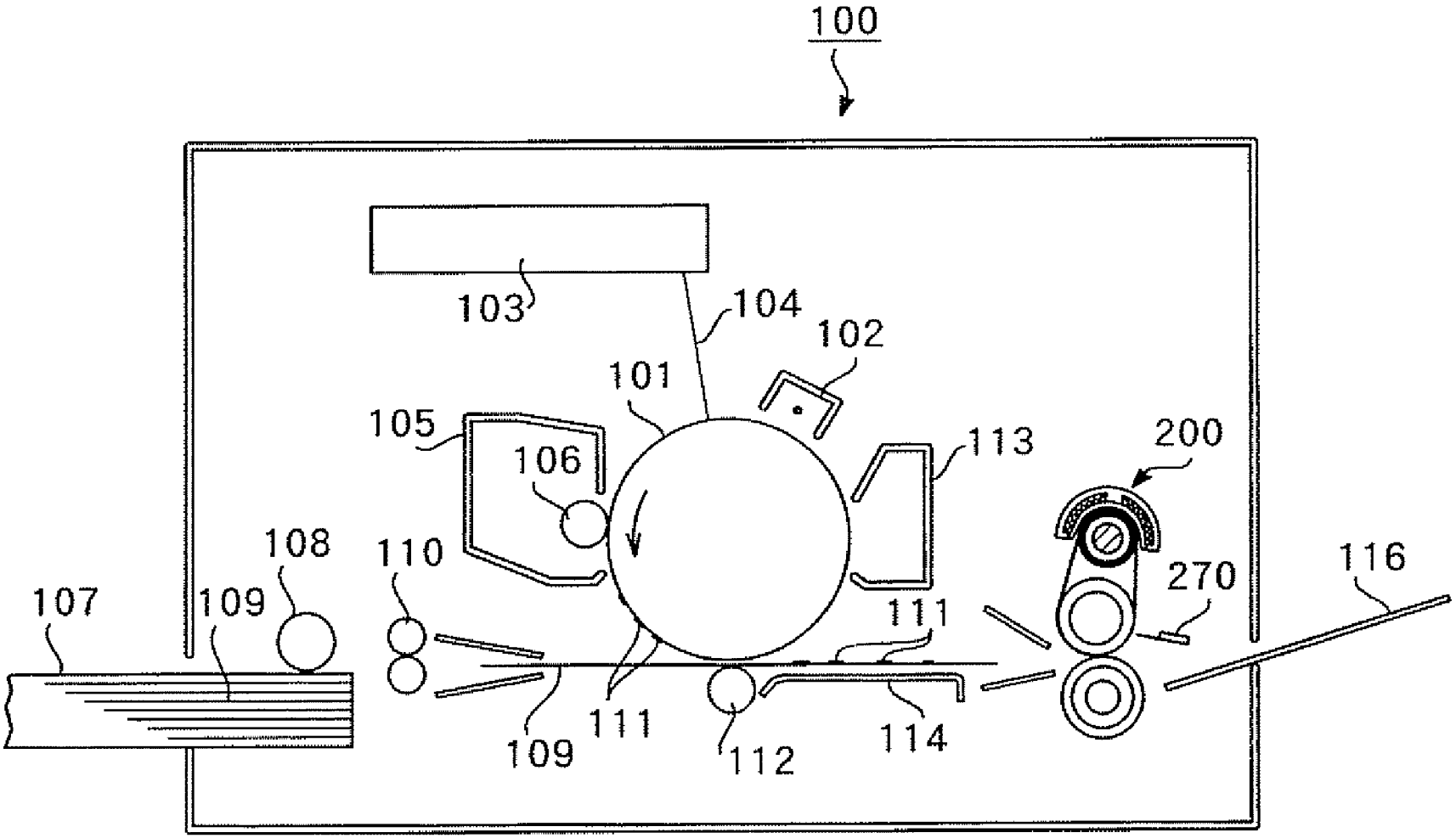
FIG. 1 is a schematic cross-sectional view showing the overall configuration of an image forming apparatus using a heating apparatus according to Embodiment 1 of the present invention as a fixing apparatus that heat-fixes an unfixed image onto a recording medium.

Now, embodiments of the present invention will be described in detail with reference to the attached drawings. In the respective drawings, components and equivalent parts having identical configurations or functions are assigned the same reference numerals and explanations thereof will not be repeated.

EMBODIMENT 1

FIG. 1 is a schematic cross-sectional view showing the overall configuration of an image forming apparatus using a heating apparatus according to Embodiment 1 of the present invention as a fixing apparatus that heat-fixes an unfixed image onto a recording medium.

As shown in FIG. 1, image forming apparatus 100 includes electrophotographic photosensitive body (hereinafter referred to as "photosensitive drum") 101, electrifier 102, laser beam scanner 103, developer 105, sheet feeding apparatus 107, fixing apparatus 200 and cleaning apparatus 113 or the like.

In FIG. 1, while photosensitive drum 101 is driven to rotate in a direction indicated by an arrow at a predetermined circumferential velocity, the surface thereof is uniformly charged to predetermined negative dark potential V0 by electrifier 102.

Laser beam scanner 103 outputs laser beam 104 modulated according to a time-series electric digital pixel signal of image information input from a host apparatus such as image reader (not shown) or computer, and scans and exposes the surface of uniformly charged photosensitive drum 101 with laser beam 104. This causes the potential absolute value of the exposed part of photosensitive drum 101 to decrease to light potential VL and causes an electrostatic latent image to be formed on the surface of photosensitive drum 101.

Developer 105 includes developing roller 106 which is driven to rotate. Developing roller 106 is disposed so as to face photosensitive drum 101 and a toner thin layer is formed on the outer surface thereof. Furthermore, a developing bias voltage whose absolute value is smaller than dark potential V0 of photosensitive drum 101 and greater than light potential VL is applied to developing roller 106.

This causes the negatively charged toner on developing roller 106 to be stuck to only the portion of light potential VL on the surface of photosensitive drum 101, the electrostatic latent image formed on the surface of photosensitive drum 101 is reversely developed into a visible image and unfixed toner image 111 is formed on photosensitive drum 101.

On the other hand, sheet feeding apparatus 107 feeds recording sheet 109 as a recording medium, one sheet at a time at predetermined timing by means of sheet feeding roller 108. Recording sheet 109 fed from sheet feeding apparatus 107 passes between a pair of resist roller 110 and is sent into a nip section between photosensitive drum 101 and transfer roller 112 at appropriate timing synchronized with the rotation of photosensitive drum 10l. In this way, unfixed toner image 111 on photosensitive drum 101 is transferred to recording sheet 109 by transfer roller 112 to which a transfer bias is applied.

In this way, recording sheet 109 on which unfixed toner image 111 is formed and supported is guided by recording sheet guide 114, separated from photosensitive drum 101 and then carried to a fixing portion of fixing apparatus 200. Fixing apparatus 200 heat-fixes unfixed toner image 111 onto recording sheet 109 carried to the fixing portion.

Recording sheet 109 on which unfixed toner image 111 is heat-fixed passes through fixing apparatus 200 and then ejected onto sheet ejection tray 116 disposed outside image forming apparatus 100.

On the other hand, residue such as remaining toner after the transfer on the surface of photosensitive drum 101 after recording sheet 109 is separated is removed by cleaning apparatus 113 and repeatedly served for formation of the next image.

Figure 2:
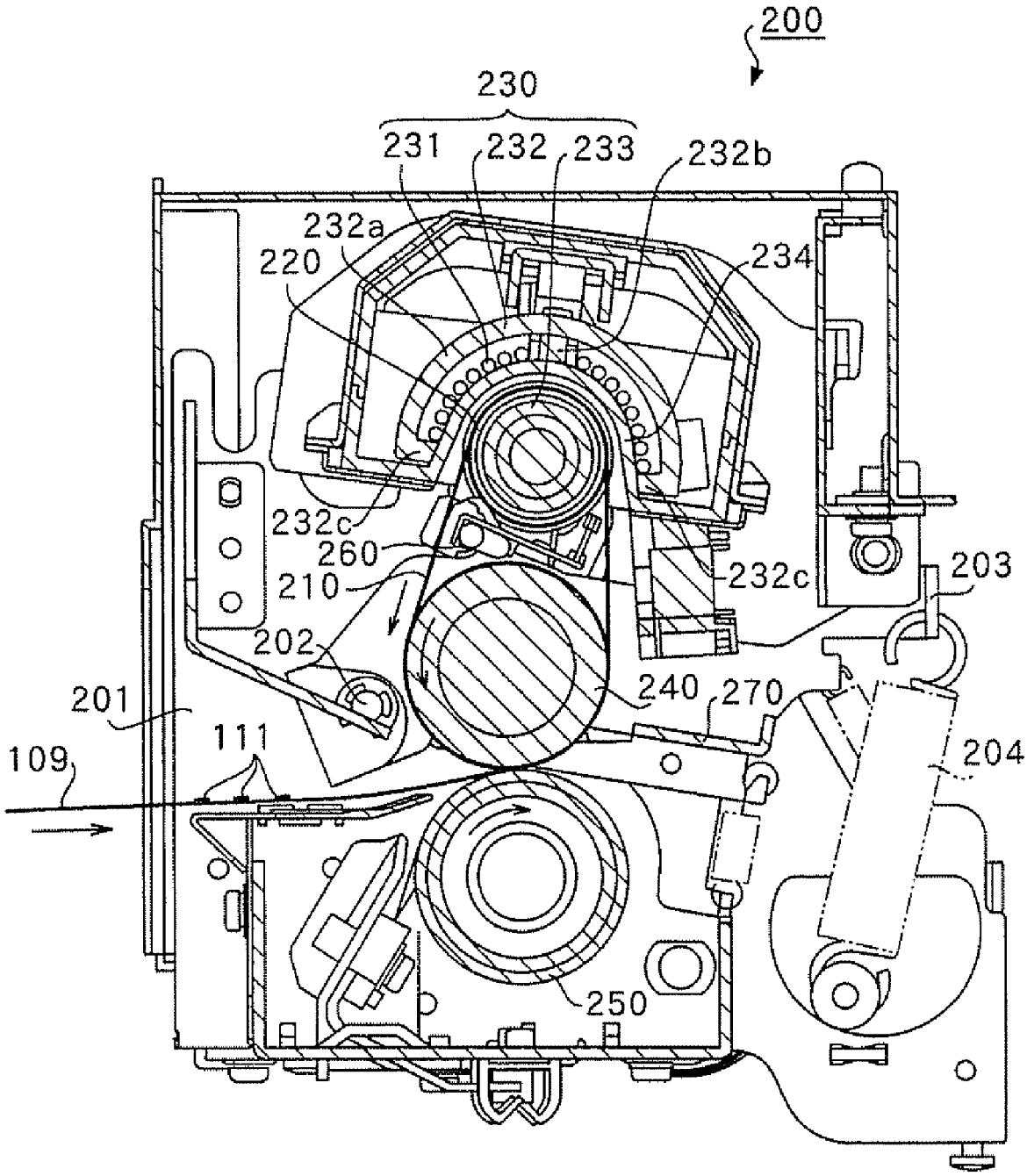
FIG. 2 is a cross-sectional view showing the basic configuration of a fixing apparatus using the heating apparatus according to Embodiment 1 as a heating section.

Next, fixing apparatus 200 of image forming apparatus 100 shown in FIG. 1 will be explained. FIG. 2 is a cross-sectional view showing the configuration of this fixing apparatus 200. As shown in FIG. 2, fixing apparatus 200 of this image forming apparatus 100 includes heat generating belt 210 as a heating element, support roller 220 as a belt support member, heating apparatus 230 as a heating section that heats heat generating belt 210 by means of electromagnetic induction, fixing roller 240 over which heat generating belt 210 is suspended and pressure roller 250 as a belt rotation section or the like.

In FIG. 2, heat generating belt 210 is suspended over support roller 220 and fixing roller 240. Support roller 220 is rotatably pivoted in an upper part of body side plate 201 of fixing apparatus 200. Fixing roller 240 is rotatably supported to oscillating plate 203 which is oscillatably attached to body side plate 201 by means of short shaft 202. Pressure roller 250 is rotatably supported in a lower part of body side plate 201 of fixing apparatus 200.

Oscillating plate 203 oscillates around short shaft 202 clockwise by means of the contracting behavior of coil spring 204. Fixing roller 240 displaces in accordance with the oscillation of this oscillating plate 203 and is pressed against pressure roller 250 with heat generating belt 210 interposed therebetween.

Pressure roller 250 is driven to rotate in a direction indicated by an arrow by a drive source (not shown). Fixing roller 240 rotates following the rotation of pressure roller 250 with heat generating belt 210 interposed therebetween. This causes heat generating belt 210 to rotate in a direction indicated by an arrow by being interposed between fixing roller 240 and pressure roller 250. Through the rotation of this heat generating belt 210 interposed between the two rollers, a nip section is formed between heat generating belt 210 and pressure roller 250, to heat-fix unfixed toner image 111 onto recording sheet 109.

Heating apparatus 230 is constructed of the aforementioned electromagnetic induction heating section based on an IH scheme, and as shown in FIG. 2, heating apparatus 230 includes exciting coil 231 disposed around the outer surface of the portion of heat generating belt 210 suspended over support roller 220, core 232 made of ferrite that covers exciting coil 231 and opposed core 233 that faces exciting coil 231 with heat generating belt 210 and support roller 220 interposed therebetween.

Exciting coil 231 is formed of a litz wire which is a bundle of thin wires and has a semi-circular cross section so as to cover the outer surface of heat generating belt 210 suspended over support roller 220. An excitation current having a drive frequency of approximately 25 kHz is applied to exciting coil 231 from an exciting circuit (not shown). This generates an AC magnetic field between core 232 and opposed core 233, generates an eddy current in a conductive layer of heat generating belt 210 and causes heat generating belt 210 to generate heat. In this embodiment, heat generating belt 210 is designed to generate heat, but it is also possible to cause support roller 220 to generate heat and transmit heat of this support roller 220 to heat generating belt 210.

Core 232 is constructed of arch cores 232*a* formed in an arch shape to cover the back of exciting coil 231, center core 232*b* disposed in the center of the winding of exciting coil 231 and side cores 232*c* disposed at both ends of the winding bundle of exciting coil 231. As the material of core 232, a material with high magnetic permeability such as permalloy can be used in addition to ferrite.

Center core 232*b* and side cores 232*c* together with arch cores 232*a* construct a magnetic path.

For this reason, outside heat generating belt 210, most of magnetic flux generated by exciting coil 231 passes through the interior of these three types of core and little magnetic flux leaks out of the core.

Figure 3:
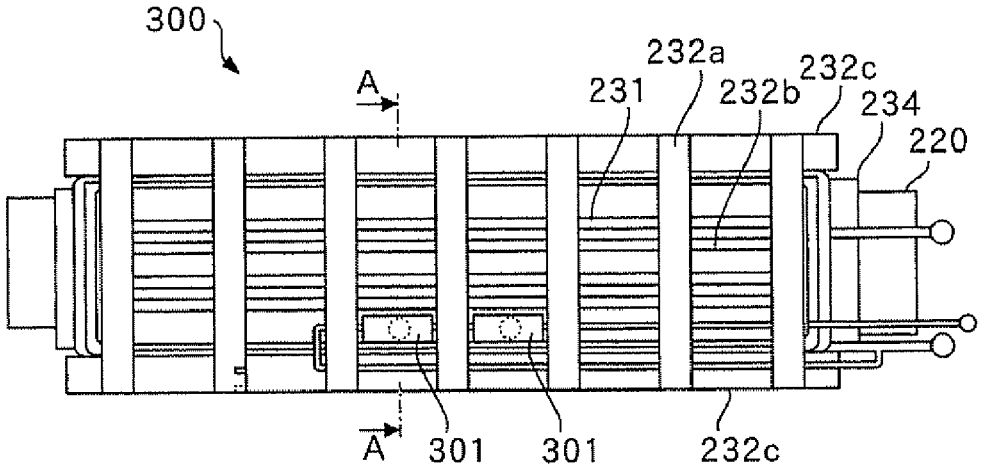
FIG. 3 is a schematic plan view showing the configuration of the heating apparatus according to Embodiment 1.

Furthermore, center core 232*b* and side cores 232*c* have cross sections which are uniform in the longitudinal direction (left-to-right direction in the figure) For this reason, even when arch cores 232*a* are dispersed as shown in FIG. 3, magnetic flux which penetrates heat generating belt 210 is made uniform in the longitudinal direction (left-to-right direction in the figure) by center core 232*b* and side cores 232*c*, and therefore the temperature distribution in the longitudinal direction of heat generating belt 210 is substantially made uniform.

Here, center core 232*b* and side cores 232*c* may be constructed together with arch cores 232*a* as a single unit or may also be constructed by combining different members.

As shown in FIG. 2, fixing apparatus 200 constructed in this way sends recording sheet 109 to which unfixed toner image 111 is transferred in a direction indicated by an arrow in such a way that the side of recording sheet 109 carrying unfixed toner image 111 touches heat generating belt 210, and can thereby heat-fix unfixed toner image 111 onto recording sheet 109.

Temperature sensor 260 made up of a thermistor is provided so as to contact a portion of the back of heat generating belt 210 past the contact area with support roller 220. Through this temperature sensor 260, the temperature of heat generating belt 210 is detected. The output of temperature sensor 260 is given to a control apparatus (not shown). The control apparatus controls power (excitation current) supplied to exciting coil 231 via the exciting circuit so as to obtain an optimum image fixing temperature based on the output of temperature sensor 260 and thereby controls the heat value of heat generating belt 210.

Furthermore, sheet ejection guide 270 is provided in an area where the portion of heat generating belt 210 suspended over fixing roller 240 downstream in the transfer direction of recording sheet 109 so as to guide recording sheet 109 which has been heat-fixed to sheet ejection tray 116.

Furthermore, heating apparatus 230 is provided with coil guide 234 as a holding member integral with exciting coil 231 and core 232.

Core 232 shown in FIG. 2 has a semi-circular cross section, but this core 232 is not required to have a shape along the shape of exciting coil 231 and may have a quasi-Π shape.

Heat generating belt 210 is constructed of a thin endless belt having a diameter of 50 mm and thickness of 50 μm, in the base material of which a conductive layer is formed by dispersing silver powder in polyimide resin having a glass transition point of 360 (degrees). The conductive layer may be composed of 2 or 3 laminated silver layers with a thickness of 10 μm. Furthermore, the surface of this heat generating belt 210 may also be coated with a 5 μm thick release layer of fluorine resin (not shown) to provide releasability. It is preferable for the glass transition point of the base material of heat generating belt 210 to be in a range from 200 (degrees) to 500 (degrees) Furthermore, for the mold release layer on the surface of heat generating belt 210, resin and rubber having good mold releasability such as PTFE (PolyTetra-Fluoro Ethylene), PFA (Per Fluoro Alkoxy Fluoroplastics), FEP (Fluorinated Etyiene Propylene copolymer), silicon rubber, fluorine rubber or the like may be used singly or in combination.

As the base material of heat generating belt 210, in addition to the above polyimide resin, a heat-resistant resin such as fluorine resin or metal such as an electroformed thin nickel sheet or thin stainless sheet can also be used. For example, this heat generating belt 210 may be configured with 10 μm thick copper coating on a 40 μm thick SUS430 (magnetic) or SUS304 (non-magnetic) surface, or a nickel electrocast belt of 30 to 60 μm thick.

Furthermore, when heating generating belt 210 is used as an image heating body for thermal fixing of a monochrome image, it is sufficient to secure releasability, but, when heating generating belt 210 is used as an image heating body for thermal fixing of a color image, it is preferable to form a rubber layer to provide elasticity for heat generating belt 210.

Support roller 220 is a cylindrical metal roller 20 mm in diameter, 320 mm in length, and 0.2 mm in thickness. As the material of support roller 220, metal such as iron, aluminum, copper or nickel may be used, but a non-magnetic stainless material having resistivity of 50 μΩcm or higher is preferable. Support roller 220 made of a non-magnetic stainless material of SUS304 has high resistivity of 72 μΩcm and is non-magnetic, and therefore magnetic flux that passes through support roller 220 is not shielded, and, for example, a support roller having a thickness of 0.2 mm generates less heat. Furthermore, support roller 220 made of SUS304 also has high mechanical strength and its thickness can be reduced to 0.1 mm or less so as to further reduce thermal capacity and is suitable for use in fixing apparatus 200 of this configuration. Furthermore, it is desirable that support roller 220 has its relative magnetic permeability of 4 or less and to be in a range from 0.04 mm to 0.2 mm in thickness.

Fixing roller 240 is made of silicon rubber which is an elastic foam material having low surface hardness (here, ASKER C30 degrees), 30 mm in diameter, low thermal conductivity and elasticity.

Pressure roller 250 is made of silicon rubber having hardness of ASKER C65 degrees. As the material of this pressure roller 250, heat-resistant resin or other rubber such as fluorine rubber or fluorine resin may be used. Furthermore, it is preferable for the surface of pressure roller 250 to be coated with resin or rubber such as PFA, PTFE or FEP singly or in combination, to enhance wear resistance and releasability. Furthermore, it is desirable for pressure roller 250 to be made of a material with low thermal conductivity.

Next, the configuration of the heating apparatus according to Embodiment 1 will be explained in detail. FIG. 3 is a schematic plan view showing the configuration of the heating apparatus according to Embodiment 1 FIG. 4 is a cross-sectional view along line A-A of the heating apparatus in FIG. 3 according to Embodiment 1 and FIG. 5 is a graph showing a heat value of the heating apparatus according to Embodiment 1.

Figure 4:
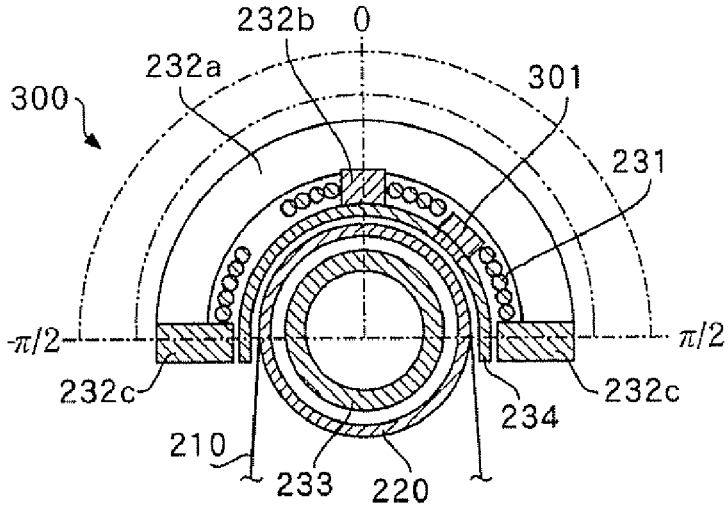
FIG. 4 is a cross-sectional view along line A-A of the heating apparatus in FIG. 3 according to Embodiment 1.
Figure 5:
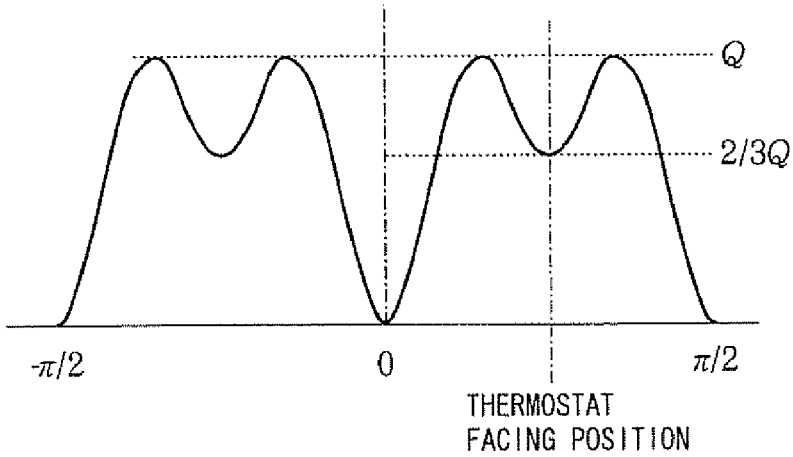
FIG. 5 is a graph showing a heat value of the heating apparatus according to Embodiment 1.

As shown in FIG. 3 and FIG. 4, heating apparatus 300 according to Embodiment 1 includes not only aforementioned heat generating belt 210, exciting coil 231, arch cores 232*a*, center core 232*b*, side cores 232*c* and opposed core 233, but also thermostat 301 as an abnormally high temperature detection section that detects that heat generating belt 210 is heated to an abnormally high temperature.

Thermostats 301 of heating apparatus 300 according to Embodiment 1 in FIG. 3 and FIG. 4 are disposed on the same side as exciting coil 231 with respect to heat generating belt 210 and between the winding bundles of the conductor wire of exciting coil 231. Here, the "winding bundle" of the conductor wire refers to a bundle of conductor wire through which a current flows in the same direction and "between the winding bundles of the conductor wire" refers to between conductor wires making up the winding bundle.

In this way, thermostat 301 in this heating apparatus 300 is disposed on the same side as exciting coil 231 and between the winding bundles of the conductor wire of exciting coil 231, that is, at positions preventing thermostats 301 from misoperating due to influences of a magnetic field generated by exciting coil 231.

That is, thermostats 301 are disposed at positions outside the magnetic path made up of arch cores 232*a*, center core 232*b*, side cores 232*c* and opposed core 233 and through which most of magnetic flux passes, that is, at positions preventing thermostats 301 from misoperating due to influences of the material and temperature characteristic of heat generating belt 210.

Therefore, this heating apparatus 300 can hold both thermostat 301 and exciting coil 231 to coil guide 234 and concentrate these wires and terminals on one location, and therefore it is possible to reduce the number of parts and assembling man-hours and configure a low-cost and compact apparatus as a whole.

Furthermore, in this heating apparatus 300, thermostat 301 reliably operates when heat generating belt 210 is heated to an abnormally high temperature regardless of whether the material of heat generating belt 210 is a magnetic member or whether the temperature of heat generating belt 210 exceeds a Curie temperature.

Furthermore, since this heating apparatus 300 has less influence of magnetic flux on thermostat 301, even if thermostat 301 has a configuration including a magnetic substance, its own heat generation is small and the influence of heat generation of thermostat 301 itself on a heat generation temperature distribution of heat generating belt 210 is also small.

Furthermore, the area where thermostat 301 is disposed in this heating apparatus 300 corresponds to an area where heat value Q (see FIG. 5) of heat generating belt 210 increases compared to other areas of heating apparatus 300. Therefore, in this heating apparatus 300, thermostat 301 operates speedily and reliably when heat generating belt 210 reaches an abnormally high temperature. By the way, heat value Q of heat generating belt 210 reaches a maximum at the center position of the winding bundle of the conductor wire of exciting coil 231, that is, on both sides of the area where thermostat 301 is disposed as shown in FIG. 5.

Furthermore, in this heating apparatus 300, portions of the conductor wire of exciting coil 231 in the areas where thermostats 301 are disposed are parallel to each other along the longitudinal direction (sheet passage width direction) of heat generating belt 210. That is, the conductor wire of exciting coil 231 in this heating apparatus 300 is wound linearly except areas where thermostats 301 are disposed as shown in FIG. 3 and FIG. 4.

In exciting coil 231 configured in this way, the conductor wire of its winding bundle has a uniform density at all positions in the longitudinal direction, and therefore the intensity of the magnetic field along the longitudinal direction of heat generating belt 210 becomes uniform, and thus the heat generation temperature distribution in the longitudinal direction of heat generating belt 210 becomes substantially uniform.

Furthermore, in this heating apparatus 300, the winding bundle of the conductor wire of exciting coil 231 is symmetric with respect to the center of the winding of the conductor wire. That is, the winding bundle of the conductor wire of exciting coil 231 in this heating apparatus 300 is configured in such a way that the areas where thermostats 301 are disposed and areas where thermostats 301 are not disposed have the same shape as shown in FIG. 3 and FIG. 4.

Exciting coil 231 configured in this way is symmetric with respect to winding center O of exciting coil 231 as shown in FIG. 4 and heat value Q of heat generating belt 210 becomes identical on the left and right of winding center O as shown in FIG. 5, preventing the problem that heat generating belt 210 reaches an abnormally high temperature in areas where thermostats 301 are not disposed, causing the operation of thermostat 301 to delay.

EMBODIMENT 2

Figure 6:
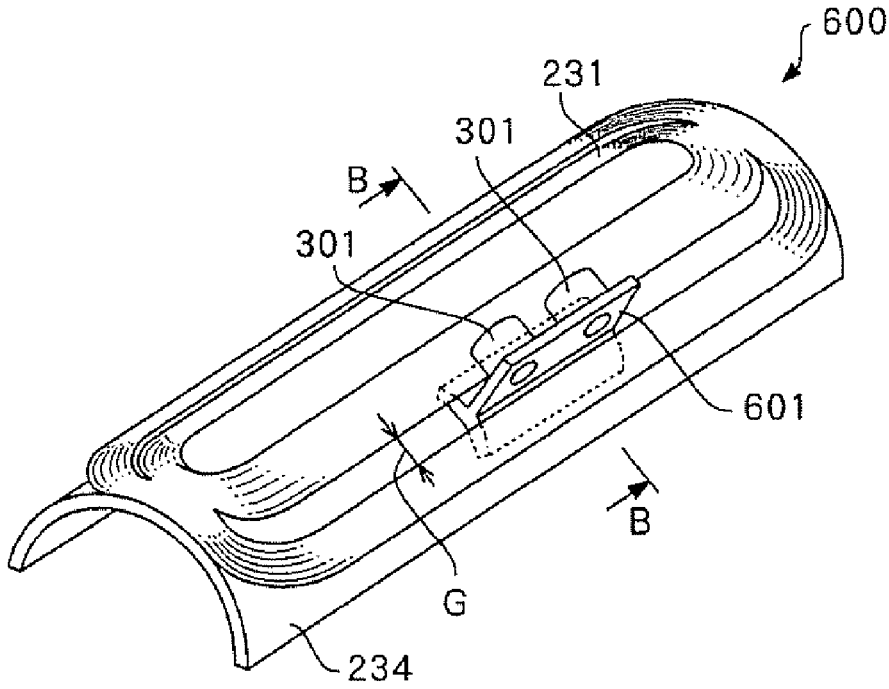
FIG. 6 is a schematic perspective view showing the configuration of a heating apparatus according to Embodiment 2 of the present invention.
Figure 7:
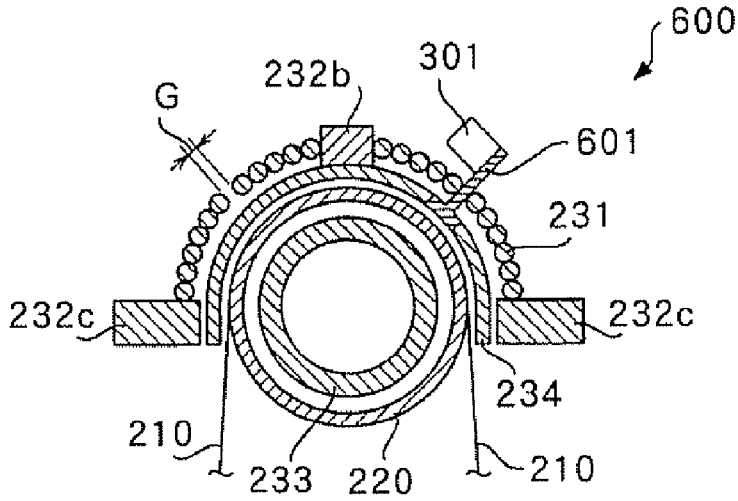
FIG. 7 is a cross-sectional view along line B-B of the heating apparatus in FIG. 6 according to Embodiment 2.

Next, the configuration of characteristic parts of a heating apparatus according to Embodiment 2 of the present invention will be explained. FIG. 6 is a schematic perspective view showing the configuration of a heating apparatus according to Embodiment 2. FIG. 7 is a cross-sectional view along line B-B of the heating apparatus in FIG. 6 according to Embodiment 2. As shown in FIG. 6 and FIG. 7, heating apparatus 600 according to Embodiment 2 is configured so as to operate thermostats 301 through thermal conduction of flat-shaped thermal conductor 601 and the rest of the configuration is the same as that of heating apparatus 300 according to Embodiment 1.

Here, thermal conductor 601 is disposed between conductor wires of exciting coil 231 such that the plane thereof is directed along the winding direction of the conductor wire of exciting coil 231 and thermostats 301 are disposed on the side of an extending section of thermal conductor 601.

Heating apparatus 600 configured in this way allows bypass width G of the conductor wire of exciting coil 231 effected when the conductor wire bypasses the areas where thermostats 301 are disposed to be reduced as shown in FIG. 6, making it possible to suppress a drop in the output of exciting coil 231 caused by a reduction in the number of windings of the conductor wire due to the placement of thermostats 301.

Here, it is preferable to make thermal conductor 601 with non-magnetic, highly thermal conductive metal. That is, thermal conductor 601 made of non-magnetic, highly thermal conductive metal is unaffected by the magnetic field generated by exciting coil 231, which prevents a problem that self heat generation of thermal conductor 601 causes heat generating belt 210 to locally generate heat.

EMBODIMENT 3

Figure 8:
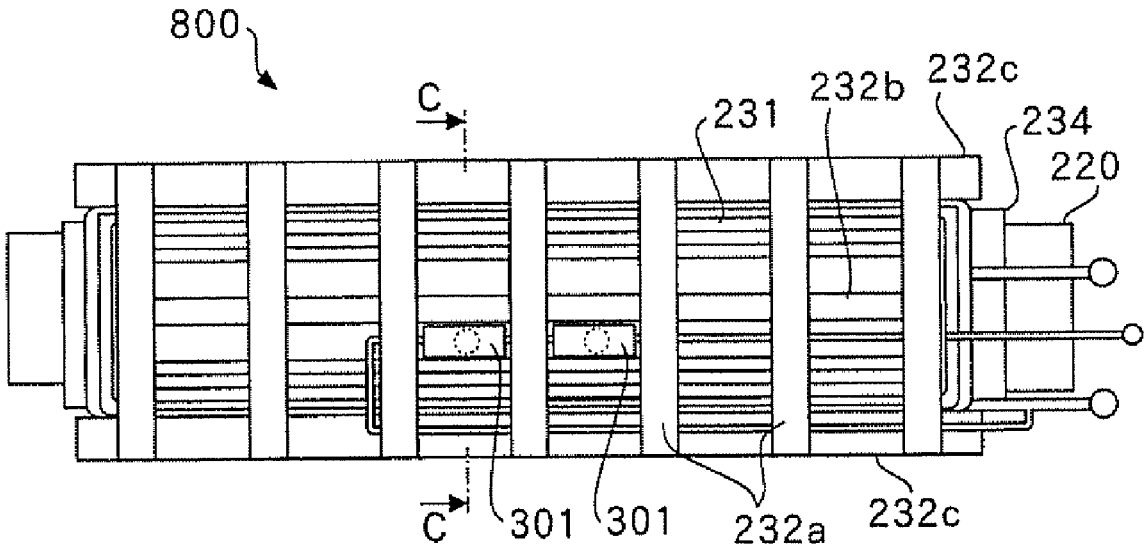
FIG. 8 is a schematic plan view showing the configuration of a heating apparatus according to Embodiment 3 of the present invention.
Figure 9:
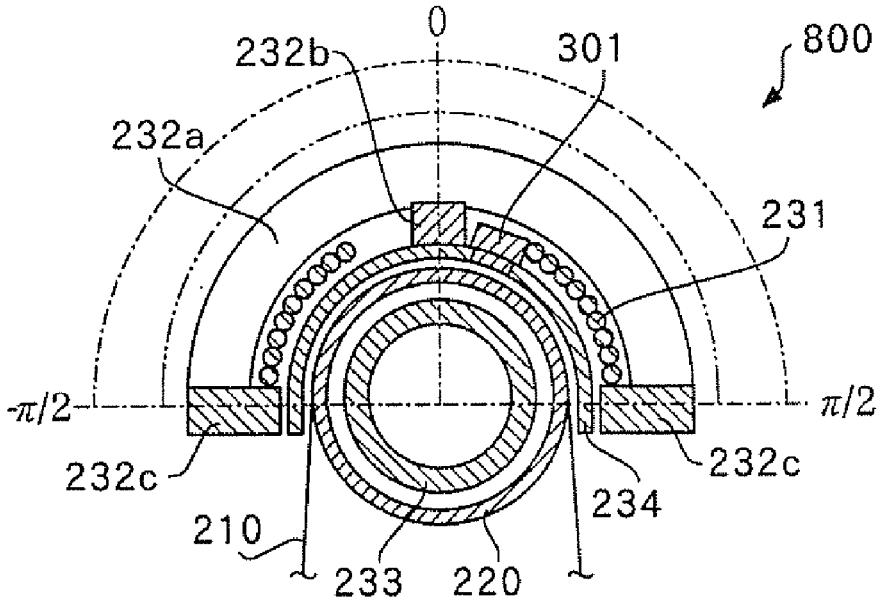
FIG. 9 is a cross-sectional view along line C-C of the heating apparatus in FIG. 8 according to Embodiment 3.

Next, the configuration of characteristic parts of a heating apparatus according to Embodiment 3 will be explained. FIG. 8 is a schematic plan view showing the configuration of a heating apparatus according to Embodiment 3. FIG. 9 is a cross-sectional view along line C-C of the heating apparatus in FIG. 8 according to Embodiment 3 of the present invention and FIG. 10 is a graph showing a heat value of the heating apparatus according to Embodiment 3 of the present invention.

As shown in FIG. 8 and FIG. 9, this heating apparatus 800 is provided with thermostats 301 disposed on the side of the winding bundle of the conductor wire of exciting coil 231 in such a way as to be interposed between exciting coil 231 and center core 232*b* and the rest of the configuration is the same as that of heating apparatus 300 according to Embodiment 1.

In this heating apparatus 800, since thermostats 301 are disposed on the side of the winding bundle of the conductor wire of exciting coil 231, it is not necessary to change the way of winding the conductor wire of exciting coil 231 when this thermostat 301 is disposed. Therefore, this heating apparatus 800 allows exciting coil 231 in the conventional configuration to be used as is, making it possible to reduce the manufacturing cost.

Figure 10:
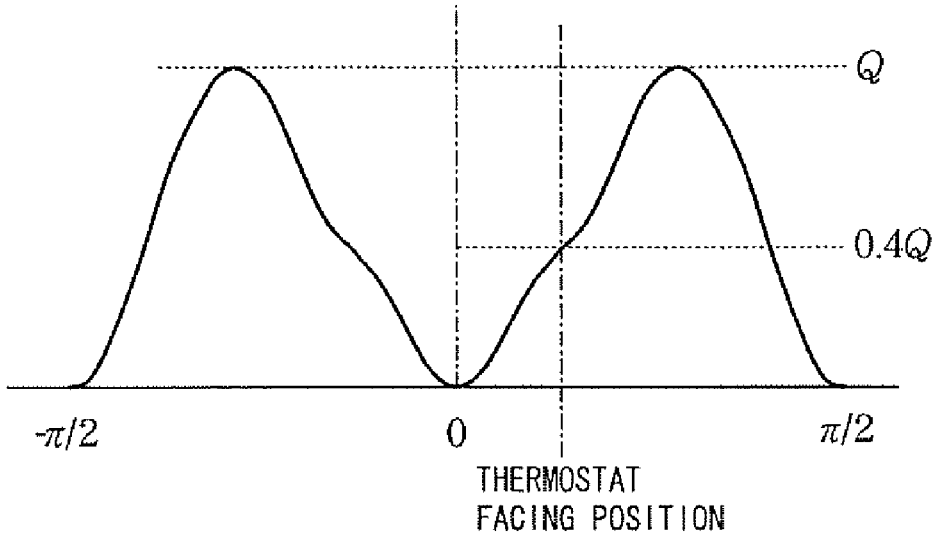
FIG. 10 is a graph showing a heat value of the heating apparatus according to Embodiment 3.

Furthermore, in this heating apparatus 800, heat value Q of heat generating belt 210 on the side of the winding bundle of the conductor wire of exciting coil 231 where thermostat 301 is disposed increases next to heat values Q at positions between winding bundles of the conductor wire of exciting coil 231 as shown in FIG. 10, and therefore when heat generating belt 210 reaches an abnormally high temperature, it is possible to relatively speedily and reliably operate thermostat 301.

Figure 11:
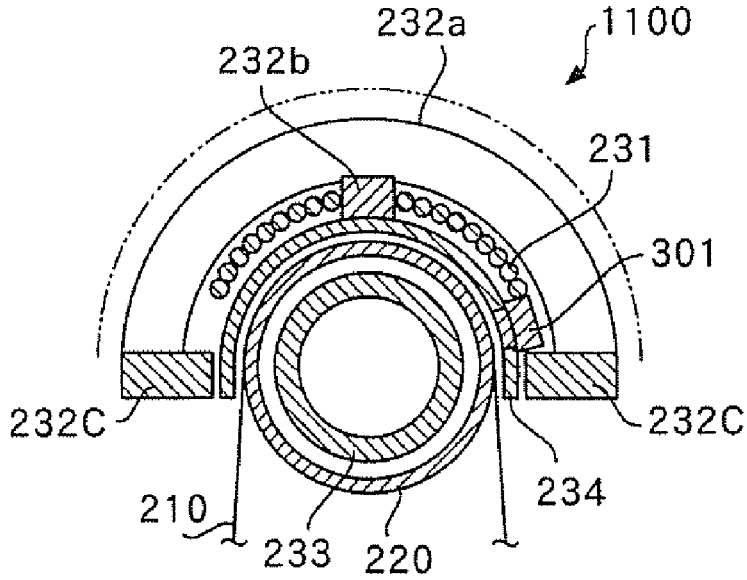
FIG. 11 is a schematic cross-sectional view showing another configuration of the heating apparatus according to Embodiment 3.

Here, FIG. 8 and FIG. 9 show an example where thermostat 301 in heating apparatus 800 is disposed on the winding center side (inner side of the winding bundle) of the conductor wire of exciting coil 231, but a similar effect can also be obtained even when this thermostat 301 is interposed between exciting coil 231 and center core 232*c* on the outer side of the winding bundle of the conductor wire of exciting coil 231 as in the case of heating apparatus 1100 shown in FIG. 11.

On the other hand, in heating apparatuses 300, 600, 800, 1100 according to the above described embodiments, center core 232*b* made of a ferromagnetic member is disposed at winding center O of the conductor wire of exciting coil 231. In heating apparatuses 300, 600, 800, 1100 in such a configuration, magnetic flux generated from exciting coil 231 is concentrated on center core 232*b*, and therefore compared to a center-core-less type without center core 232*b*, leakage of magnetic flux from exciting coil 231 is reduced, making it possible to suppress a drop in the output of exciting coil 231 due to this leakage flux or the like.

Furthermore, heating apparatuses 300, 600, 800, 1100 according to the above described embodiments adopt the configuration in which side core 232*c* made of a ferromagnetic member is disposed on the outer side of the winding bundle of the conductor wire of exciting coil 231 and thermostat 301 is interposed between center core 232*b* and side core 232*c*. Heating apparatuses 300, 600, 800, 1100 in such a configuration have the configuration in which thermostat 301 is disposed at a position outside the magnetic path of magnetic flux generated from exciting coil 231, and therefore self heat generation of thermostat 301 due to influences of the magnetic flux is reduced.

Heating apparatuses 300, 600, 800, 110 according to the above described embodiments use at least one thermostat 301 as the abnormally high temperature detection section, and can thereby be constructed at lower cost. Here, if a plurality of thermostats 301 are provided, even when all thermostats 301 except one thermostat 301 fail, it is possible to detect an abnormally high temperature of heat generating belt 210 and thereby improve the safety of the apparatus. When a plurality of thermostats 301 are disposed, it is preferable to dispose respective thermostats 301 at symmetric positions so as to uniformly distribute influences of thermostats 301 on heat generating belt 210.

Furthermore, heating apparatuses 300, 600, 800, 1100 according to the above described embodiments dispose thermostat 301 in the area (central part in the longitudinal direction of exciting coil 231) facing the minimum heated area of heat generating belt 210 that heats a heated body (here recording sheet 109) in a minimum size that can be heated. In heating apparatuses 300, 600, 800, 1100 in such a configuration, when heat generating belt 210 is heated, thermostat 301 is always ready to operate, making it possible to prevent heat generating belt 210 from being heated to an abnormally high temperature in a heated area that cannot be detected by thermostat 301 and improve reliability in safety.

Furthermore, heating apparatuses 300, 600, 800, 1100 according to the above described embodiments adopt a configuration in which exciting coil 231 and core 232 are disposed so as to face each other along the outer surface of heat generating belt 210 which is made up of a body of rotation. Furthermore, in heating apparatuses 300, 600, 800, 1100 in such a configuration, it is not necessary to remove exciting coil 231 and core 232 when replacing heat generating belt 210 and support roller 220, and therefore it is possible to easily perform maintenance or the like of the apparatus.

Figure 12:
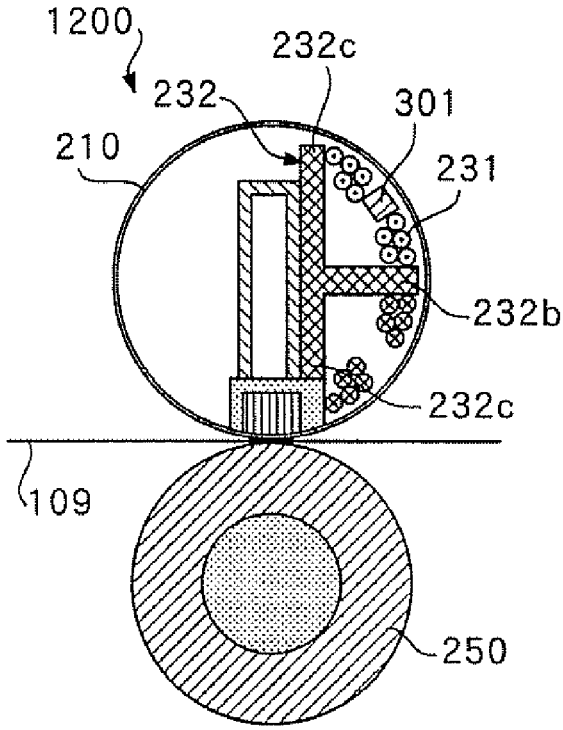
FIG. 12 is a schematic cross-sectional view showing another configuration of the heating apparatus according to Embodiment 1.
Figure 13:
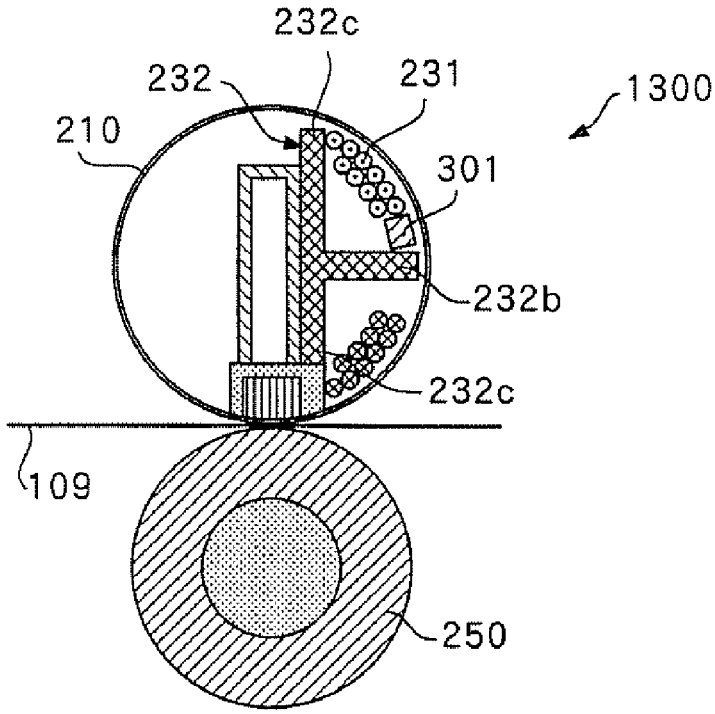
FIG. 13 is a schematic cross-sectional view showing a further configuration of the heating apparatus according to Embodiment 3.

Here, when the compactness of the body of the apparatus should be emphasized without considering the above described maintenance of the apparatus or the like, exciting coil 231 and core 232 may be disposed inside heat generating belt 210 which is the body of rotation as shown in FIG. 12 and FIG. 13. Here, heating apparatus 1200 shown in FIG. 12 is an example where thermostat 301 is disposed between the winding bundles of the conductor wire of exciting coil 231. Furthermore, heating apparatus 1300 shown in FIG. 13 is an example where thermostat 301 is disposed on the side of the winding bundle of the conductor wire of exciting coil 231.

Furthermore, in heating apparatuses 300, 600, 800, 1100 according to the above described embodiments, heat generating belt 210 is supported by support roller 220 and fixing roller 240, but this heat generating belt 210 itself may also be formed in a roller shape as in the cases of heating apparatuses 1200, 1300 shown in FIG. 12 and FIG. 13 so as to have the function as fixing roller 240.

Furthermore, the above described embodiments use thermostat 301 as an abnormally high temperature detection section, but a temperature fuse which is blown when a set temperature is exceeded may also be used. Furthermore, it goes without saying that it is also possible to use a thermistor as the abnormally high temperature detection section and combine an electronic circuit for shutting off a power supply to exciting coil 231 when the thermistor detects a high temperature exceeding a set temperature as a substitute for thermostat 301.

EMBODIMENT 4

Figure 14:
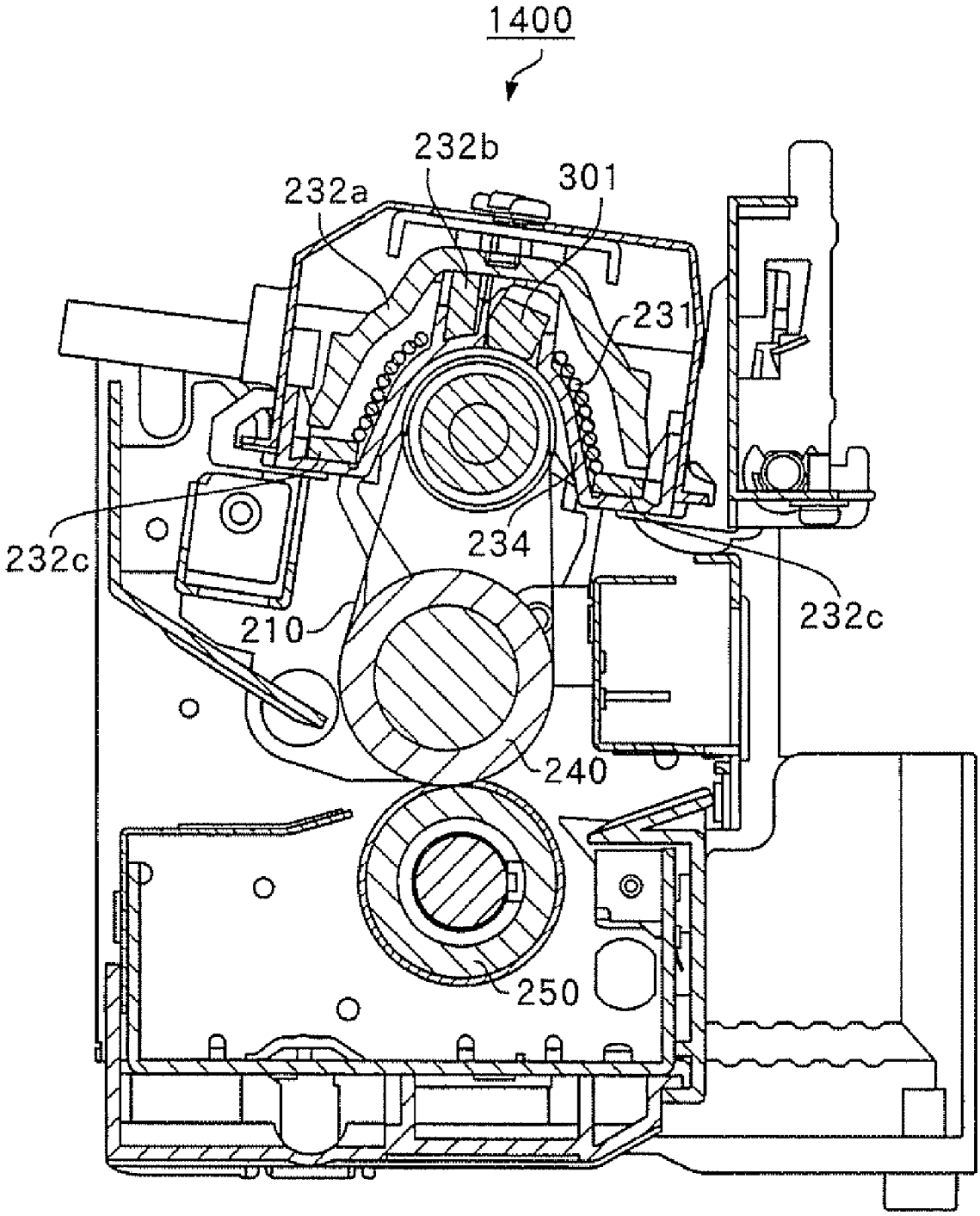
FIG. 14 is a schematic cross-sectional view showing the configuration of a fixing apparatus according to Embodiment 4 of the present invention.

Next, the configuration of characteristic parts of a heating apparatus according to Embodiment 4 will be explained. FIG. 14 is a cross-sectional view showing the configuration of fixing apparatus 1400 using a heating apparatus according to Embodiment 4 of the present invention. In FIG. 14, the same components as those in fixing apparatus 200 in FIG. 2 according to Embodiment 1 are assigned the same reference numerals and explanations thereof will be omitted.

As shown in FIG. 14, in contrast to the configuration of heating apparatus 800 according to Embodiment 3 shown in FIG. 8 and FIG. 9 in which center core 232*b* is disposed at the winding center of exciting coil 231, this heating apparatus 1400 has a configuration in which center core 232*b* is disposed sideward apart from the winding center of exciting coil 231 and thermostat 301 is disposed adjacent to center core 232*b*.

By configuring heating apparatus 1400 in this way, it is possible to dispose exciting coil 231 also in a space left to center core 232*b* of heating apparatus 800 in FIG. 9, increase a cross-sectional area of the coil and thereby improve heat generation efficiency.

A first aspect of the heating apparatus of the present invention comprises an exciting coil made up of a plurality of windings of a conductor wire for generating a magnetic field, a heating element that is heated by means of electromagnetic induction through an action of the magnetic field, and an abnormally high temperature detection section that detects that the heating element reaches an abnormally high temperature, wherein the abnormally high temperature detection section is disposed on the same side as the exciting coil with respect to the heating element and between winding bundles of the conductor wire of the exciting coil.

According to this configuration, the abnormally high temperature detection section is disposed in the same area as that of the exciting coil, and therefore it is possible to share a holding member between the abnormally high temperature detection section and the exciting coil, concentrate wires and terminals or the like of both sections on one location and thereby make the body of the apparatus in a low-cost and compact configuration. Furthermore, according to this configuration, the abnormally high temperature detection section is disposed between the winding bundles of the conductor wire of the exciting coil with the heating element having a greater heat value than other areas of the exciting coil, and therefore it is possible to speedily and reliably operate the abnormally high temperature detection section when the heating element reaches an abnormally high temperature. The heat value of the heating element reaches a maximum at the center position of the winding bundle of the conductor wire of the exciting coil.

A second aspect of the heating apparatus of the present invention is the heating apparatus according to the first aspect of the present invention, further comprising at least one of a center core made of a ferromagnetic member disposed at a center position of the winding of the conductor wire of the exciting coil and a side core made of a ferromagnetic member disposed on the outer side of the winding bundle of the conductor wire of the exciting coil.

According to this configuration, in addition to the effects of the heating apparatus according to the first aspect, the presence of the center core and the side core of the heating element reduces leakage flux that does not penetrate the heating element and can thereby suppress a drop of the output of the exciting coil. Furthermore, this configuration can make uniform a temperature distribution of the heating element in the rotating axis direction.

A third aspect of the heating apparatus of the present invention comprises an exciting coil made up of a plurality of windings of a conductor wire for generating a magnetic field, a heating element that is heated by means of electromagnetic induction through an action of the magnetic field, an abnormally high temperature detection section that detects that the heating element reaches an abnormally high temperature, and a center core made of a ferromagnetic member disposed at a center position of the winding of the conductor wire of the exciting coil, wherein the abnormally high temperature detection section is interposed between the exciting coil and the center core According to this configuration, most of the magnetic flux generated from the exciting coil passes through the center core and a heat value of the heating element in the inside of the winding bundle of the conductor wire of the exciting coil in which the abnormally high temperature detection section is disposed increases compared to a center-core-less type without the center core, and therefore it is possible to relatively speedily and reliably operate the abnormally high temperature detection section when the heating element reaches an abnormally high temperature and reduce self heat generation of the abnormally high temperature detection section due to influences of leakage flux. Furthermore, according to this configuration, it is not necessary to change the way of winding the conductor wire of the exciting coil in disposing the abnormally high temperature detection section and an exciting coil in a conventional configuration can be used as is.

A fourth aspect of the heating apparatus of the present invention comprises an exciting coil made up of a plurality of windings of a conductor wire for generating a magnetic field, a heating element that is heated by means of electromagnetic induction through an action of the magnetic field, an abnormally high temperature detection section that detects that the heating element reaches an abnormally high temperature, and a side core made of a ferromagnetic member disposed on the outer side of the winding bundle of the conductor wire of the exciting coil, wherein the abnormally high temperature detection section is interposed between the exciting coil and the side core.

According to this configuration, most of the magnetic flux in the area where the position abnormally high temperature detection section is disposed passes through the side core and a heat value of the heating element on the outer side of the winding bundle of the conductor wire of the exciting coil in which the abnormally high temperature detection section is disposed increases compared to the center-core-less type, and therefore it is possible to relatively speedily and reliably operate the abnormally high temperature detection section when the heating element reaches an abnormally high temperature and reduce self heat generation of the abnormally high temperature detection section due to influences of leakage flux.

A fifth aspect of the heating apparatus of the present invention is the heating apparatus according to the first aspect of the present invention, further comprising an opposed core disposed on the opposite side of the exciting coil with respect to the heating element for forming a magnetic path.

According to this configuration, most of the magnetic flux generated in the exciting coil passes through the opposed core, and therefore even if the material of the heating element is a non-magnetic member, it is possible to suppress a drop of the output of the exciting coil. Furthermore, in this configuration, the material of the heating element is a magnetic member and even when its temperature exceeds a Curie temperature, most of the magnetic flux passes through the opposed core as described above, and therefore less leakage flux is generated, making it possible to reliably operate the abnormally high temperature detection section.

A sixth aspect of the heating apparatus of the present invention is the heating apparatus according to any one of the first, third and fourth aspects of the present invention, wherein the conductor wires of the exciting coil in the area where the abnormally high temperature detection section is disposed are parallel to each other in a longitudinal direction of the heating element.

According to this configuration, in addition to the effects of the heating apparatus according to any one of the first, third and fourth aspects of the present invention, the magnetic field intensity along the longitudinal direction of the heating element generated by the exciting coil in the area where the abnormally high temperature detection section is disposed becomes uniform. Therefore, the heat generation temperature distribution of the heating element in the longitudinal direction becomes substantially uniform in this configuration.

A seventh aspect of the heating apparatus of the present invention is the heating apparatus according to any one of the first, third and fourth aspects, wherein the winding bundle of the conductor wire of the exciting coil is symmetric with respect to the winding center of the conductor wire.

According to this configuration, in addition to the effects of the heating apparatus according to any one of the first, third and fourth aspects of the present invention, the magnetic field intensity of the heating element becomes uniform between the area where the abnormally high temperature detection section is disposed and the area where the abnormally high temperature detection section is not disposed. Therefore, in this configuration, it is possible to prevent such trouble that the heating element reaches an abnormally high temperature in the area where the abnormally high temperature detection section is not disposed, causing the operation of the abnormally high temperature detection section to delay.

An eighth aspect of the heating apparatus of the present invention is the heating apparatus according to any one of the first, third and fourth aspects, wherein a flat-shaped thermal conductor is interposed between the conductor wires of the exciting coil in such a way that the plane of the thermal conductor is directed along the winding direction of the conductor wire and heat is transmitted to the abnormally high temperature detection section through thermal conduction of the thermal conductor.

According to this configuration, in addition to the effects of the heating apparatus according to any one of the first, third and fourth aspects of the present invention, it is possible to reduce the bypass width of the conductor wire of the exciting coil effected when bypassing the area where the abnormally high temperature detection section is disposed and suppress a drop of the output of the exciting coil caused by a reduction in the number of windings of the conductor wire due to the placement of the abnormally high temperature detection section.

A ninth aspect of the heating apparatus of the present invention is the heating apparatus according to the heating apparatus according to the eighth aspect of the present invention, wherein the thermal conductor is made of non-magnetic, highly thermal conductive metal.

According to this configuration, in addition to the effects of the heating apparatus according to the eighth aspect of the present invention, since the thermal conductor is not affected by the magnetic field generated by the exciting coil, there is no such trouble that the heating element generates heat locally through self heat generation of the thermal conductor.

A tenth aspect of the heating apparatus of the present invention is the heating apparatus according to any one of the first, third and fourth aspects of the present invention, wherein the abnormally high temperature detection section is made up of at least one thermostat.

According to this configuration, in addition to the effects of the heating apparatus according to any one of the first, third and fourth aspects of the present invention, the abnormally high temperature detection section is a thermostat, and therefore it is possible to configure the apparatus at low cost. Here, when a plurality of thermostats are provided, even if all thermostats except one thermostat fail, it is possible to detect an abnormally high temperature of the heating element and thereby improve the safety of the apparatus. Furthermore, when a plurality of thermostats are disposed, it is preferable to dispose the respective thermostats at symmetrical positions and there by uniformly distribute influences of the thermostats on the heating element.

An eleventh aspect of the heating apparatus of the present invention is the heating apparatus according to any one of the first, third and fourth aspects of the present invention, wherein the abnormally high temperature detection section is disposed in an area facing a minimum heated area of the heating element that heats a heated body in a minimum size that can be heated.

According to this configuration, in addition to the effects of the heating apparatus according to any one of the first, third and fourth aspects of the present invention, the abnormally high temperature detection section is ready for operation all the time when the heating element is heated, which prevents the heating element from reaching an abnormally high temperature in a heated area that cannot be detected by the abnormally high temperature detection section and thereby improves reliability in the safety aspect.

A twelfth aspect of the heating apparatus of the present invention is the heating apparatus according to any one of the first, third and fourth aspects of the present invention, wherein the heating element is made up of a body of rotation that moves with respect to the exciting coil and the exciting coil is disposed at an opposed position along the outer surface of the body of rotation.

According to this configuration, in addition to the effects of the heating apparatus according to any one of the first, third and fourth aspects of the present invention, it is not necessary to remove the magnetic coil when the heating element is replaced and it is possible to thereby perform maintenance or the like of the apparatus easily.

A thirteenth aspect of the heating apparatus of the present invention is the heating apparatus according to the third aspect of the present invention, wherein the center core is disposed sideward apart from the winding center of the conductor wire of the exciting coil and the abnormally high temperature detection section is disposed adjacent to the center core between the exciting coil and the center core.

According to this configuration, it is possible to dispose the exciting coil also in the space where the abnormally high temperature detection section is disposed when the center core is disposed at the winding center of the conductor wire of the exciting coil, and thereby increase the cross-sectional area of the exciting coil and improve heat generation efficiency.

A fourteenth aspect of the fixing apparatus of the present invention uses the heating apparatus according to any one of the first, third and fourth aspects of the present invention as a heating section of a heat-fixing section that heat-fixes an unfixed image formed on a recording medium.

According to this configuration, when the heating element of the heating apparatus as the heating section reaches an abnormally high temperature, the abnormally high temperature detection section is operated speedily and reliably, and therefore it is possible to prevent from occurring secondary disasters such as ignition and smoking of the recording medium.

A fifteenth aspect of the image forming apparatus of the present invention uses the fixing apparatus according to the fourteenth aspect of the present invention as a heat-fixing section that heat-fixes an unfixed image formed on a recording medium.

According to this configuration, it is possible to heat-fix an unfixed image formed on a recording medium safely using the fixing apparatus.

The present application is based on Japanese Patent Application No. 2003-404944, filed on Dec. 3, 2003, the entire content of which is expressly incorporated by reference herein.

INDUSTRIAL APPLICABILITY

The present invention is intended to enable an abnormally high temperature detection section to operate speedily and reliably when a heating element of a heating apparatus reaches an abnormally high temperature, the heating apparatus being used as a fixing apparatus of an image forming apparatus such as a copier, facsimile or printer based on an electrophotographic scheme or electrostatic recording scheme, irrespective of the material and temperature characteristic or the like of the heating element heated by means of electromagnetic induction.

The invention claimed is:

1. A heating apparatus, comprising:

a heating element that is heated by electromagnetic induction through action of a magnetic field;

an exciting coil that is disposed along the heating element and generates the magnetic field which acts on the heating element; and a detection section that is disposed adjacent to the exciting coil and comprises a magnetic member that detects an abnormally high temperature in the heating element, a center core comprising a ferromagnetic member disposed in a center area of the exciting coil; and a side core comprising a ferromagnetic member disposed on an outer side of the exciting coil, wherein the detection section is interposed between the center core and the side core, and a height of the detection section, in a direction extending away from the heating element, is less than a height of the center core and a height of the side core, in directions extending away from the heating element.

2. The heating apparatus according to claim 1, wherein the exciting coil comprises a winding bundle of a conductor wire on the center core side and a winding bundle of a conductor wire on the side core side; and wherein the detection section is interposed between the winding bundle on the center core side and the winding bundle on the side core side.

3. The heating apparatus according to claim 1, further comprising:

an opposed core forming part of the magnetic path and disposed on an opposite side of the exciting coil with respect to the heating element.

4. The heating apparatus according to claim 1, wherein the exciting coil is made of winding conductor wires; and wherein the conductor wire in an area where the detection section is disposed are parallel to each other in a longitudinal direction of the heating element.

5. The heating apparatus according to claim 1, wherein the exciting coil is symmetric with respect to a center area of the exciting coil.

6. The heating apparatus according to claim 1, wherein the detection section comprises at least one thermostat.

7. A fixing apparatus that comprises the heating apparatus according to claim 1.

8. An image forming apparatus that comprises the fixing apparatus according to claim 7.

9. The heating apparatus according to claim 1, the center core and the side core being spaced from each other about a periphery of the heating element.

10. The heating apparatus according to claim 1, the center core and side core extend longitudinally of the heating element, and are spaced from each other about a periphery of the heating element.

* * * * *